US009175363B2

(12) United States Patent
Günther et al.

(10) Patent No.: US 9,175,363 B2
(45) Date of Patent: Nov. 3, 2015

(54) METHOD FOR PRODUCING AN AGGLOMERATE MADE OF FINE MATERIAL CONTAINING METAL OXIDE FOR USE AS A BLAST FURNACE FEED MATERIAL

(75) Inventors: Theodor Günther, Tecklenburg (DE); Matthias Blöser, Velbert (DE); Denise Alfenas Moreira, Belo Horizonte (BR); Arnd Pickbrenner, Wulfrath (DE); Christopher Pust, Düsseldorf (DE); Wolfgang Rückert, Düsseldorf (DE)

(73) Assignee: Rheinkalk GmbH, Wülfrath (DE)

( * ) Notice: Subject to any disclaimer, the term of this patent is extended or adjusted under 35 U.S.C. 154(b) by 620 days.

(21) Appl. No.: 13/375,931

(22) PCT Filed: Jun. 4, 2010

(86) PCT No.: PCT/EP2010/057842
§ 371 (c)(1),
(2), (4) Date: Mar. 29, 2012

(87) PCT Pub. No.: WO2010/139789
PCT Pub. Date: Dec. 9, 2010

(65) Prior Publication Data

US 2012/0180599 A1 Jul. 19, 2012

(30) Foreign Application Priority Data

Jun. 4, 2009 (DE) ..... 10 2009 023 928

(51) Int. Cl.

| | |
|---|---|
| ***C22B 1/14*** | (2006.01) |
| ***C22B 1/24*** | (2006.01) |
| ***C22B 1/243*** | (2006.01) |
| ***C22B 1/20*** | (2006.01) |

(52) U.S. Cl.
CPC . *C22B 1/20* (2013.01); *C22B 1/205* (2013.01); *C22B 1/24* (2013.01); *C22B 1/243* (2013.01); *C22B 1/2406* (2013.01)

(58) Field of Classification Search
CPC ..... C21B 5/008; C22B 1/14; C22B 1/243
USPC ..... 75/773, 768
See application file for complete search history.

(56) References Cited

U.S. PATENT DOCUMENTS

| | | | | |
|---|---|---|---|---|
| 3,628,947 | A | 12/1971 | DeVaney et al. | |
| 3,725,032 | A * | 4/1973 | Kihlstedt | 75/318 |
| 5,364,672 | A | 11/1994 | Schultze-Kraft | |
| 5,476,532 | A * | 12/1995 | Steeghs | 75/300 |
| 7,270,704 | B2 | 9/2007 | Mozhzherin et al. | |
| 7,442,229 | B2 * | 10/2008 | Sterneland et al. | 75/469 |
| 2005/0126342 | A1 * | 6/2005 | Sterneland et al. | 75/459 |
| 2009/0202406 | A1 * | 8/2009 | Rundel | 423/138 |

FOREIGN PATENT DOCUMENTS

| | | |
|---|---|---|
| DE | 4331159 | 5/1995 |
| DE | 19629099 | 1/1998 |
| DE | 19940219 | 10/2001 |
| DE | 202006019074 | 5/2007 |
| EP | 1359129 | 11/2003 |
| GB | 805938 | 12/1958 |
| GB | 825440 | 12/1959 |
| GB | 990672 | 4/1965 |
| GB | 1162991 | 9/1969 |
| GB | 1745218 | 3/2006 |
| JP | 2002285251 | 10/2002 |
| JP | 2003049227 | 2/2003 |
| JP | 2005097687 | 4/2004 |
| JP | 60220135 | 4/2005 |
| KR | 2007000155 | 1/2007 |
| RU | 2092590 | 10/1997 |
| RU | 2241770 | 12/2004 |
| SU | 1315504 | 6/1987 |

OTHER PUBLICATIONS

Hau et al. Patent family including CN 101205570 A. Derwent Acc-No. 2008-J41855. published Jun. 25, 2008. Abstract.*

Hamer, Frank, and Janet Hamer. "The Potter's Dictionary of Materials and Techniques." Google Books. University of Pennsylvania Press, 2004. p. 269. Web. May 1, 2014. <http://books.google.com/books?id=TApnGTVLwxAC&pg=PA269&lpg=PA269&dq=what+is+%22short+clay%22&source=bl&ots=ilX5QTPg5R&sig=GWvauFY5cuTHMi6mkvKngFJBLhQ&hl=en&sa=X&ei=qYpiU7rHMYKq8QGU6.*

"Quartzite." Rock,White, Stone, Suppliers. Minerals Zone: World Mineral Exchange, n.d. Web. May 1, 2014. <http://www.mineralszone.com/stones/quartzite.html>.*

"Olivine." Encyclopaedia Britannica. Encyclopaedia Britannica Online Academic Edition. Encyclopaedia Britannica Inc., 2014. Web. May 1, 2014. <http://www.britannica.com/EBchecked/topic/427789/olivine>.*

Patent CN101205570A—Iron Ore Sintering Ignition Method. Google Books. N.p., 2012. Web. May 1, 2014.*

(Continued)

*Primary Examiner* — George Wyszomierski
*Assistant Examiner* — Tima M. McGuthry-Banks
(74) *Attorney, Agent, or Firm* — Honigman Miller Schwartz and Cohn LLP; Thomas A. Wootton, Esq.; Jonathan P. O'Brien

(57) ABSTRACT

The invention relates to a method for producing an agglomerate, which is used as a blast furnace feed material, by mixing a fine material containing metal and/or metal oxide, a mineral binder, which comprises a mineral raw material and a lime-based material, and optionally other additives to form a mass and solidifying the mass to form an agglomerate, wherein a raw material comprising a silicon oxide fraction of at least 40 wt %, a fine grain fraction of less than 4 μm of at least 20 wt %, and a grain size fraction of less than 1 μm of at least 10 wt % is used as the mineral raw material. The invention further relates to a blast furnace feed material that can be produced by means of the method according to the invention, and to a pre-mixture for producing the blast furnace feed material.

14 Claims, No Drawings

(56) References Cited

OTHER PUBLICATIONS

"Olivine." Encyclopaedia Britannica. Encyclopeadia Brittanica Online Academic Edition. Encyclopeadia Brittanica Inc., 2014. Web, May 1, 2014. http://www.britannica.com/EBchecked/topic/427789/olivine.
"Patent CN 101205570A—Iron Ore Sintering Ignition Method." Google Books, N.p., 2012. Web. May 1, 2014.
"Quartzite." Rock, White, Stone, Suppliers. Minerals Zone: World Mineral Exchange, n.d. Web. May 1, 2014.
Aiken, George E., et al., "Trends in Agglomeration", Society for Mining. Metallurgy, and Exploration. Annual Meeting, 1973.
Clem, Arthur G., and Robert W. Dohler. "Industrial Applications of Bentonite." N.p., 2010. Web. May 1, 2014. www.clays.org/journal.archive/volume%2010/10-1-272.pdf.
Czako, C.A., et al., "Laboratory Testing as Basis for Optimum Engineering of Sintering and Pelletizing Plants", Agglomeration, No. 77, vol. 2, Ch. 15, pp. 243-271, 1977.
Furui, Takeo, et al., "Technology for Preparation of Raw materials to be sintered", Nippon Steel Technical Report Overseas N°10, Nov. 1997.
Guider, James W., "Iron Ore Beneficiation—Key to Modern Steelmaking", Mining Engineering, pp. 410-413, Apr. 1981.
Hamer, Frank, and Janet Hamer. "The Potter's Dictionary of Materials and Techniques." Google Books. University of Pennsylvania Press, 2004, p. 269. Web. May 1, 2014, http://books.google.com/books?id=TApnGTVLwxAC&pg=PA269&lpg=PA269&dq=what+is+%22short+clay%22&source=bl&ots=ilX5QTPg5R&sig=GWvauFY5cuTHMi6mkvKngFJBLhQ&hl=en&sa=X&ei=qYpiU7rHMYKq8QGU6.
Hassler, Bridgitia, et al., "Cold Bonding Agglomeration", Agglomeration, No. 77, vol. 2, Ch. 53, pp. 901-909, 1977.
Hau, et al. Patent family including CN 101205570 A. Derwent Acc-No. 2008-J41855. Published Jun. 25, 2008. Abstract.
Ishikawa, Yasushi, et al., "Latest development of sintering technology", Agglomeration, No. 77, vol. 2, Ch. 28, pp. 503-525, 1977.
Minnesota Inventors Hall of Fame, "Edward W. Davis—1979 Inductee", retrieved from the internet on Jul. 30, 2014, available at http://www.minnesotainventors.org/inductees/edward-w-davis.html
Poveromo J. J., "Chapte 8: Iron Ores", in "The Making, Shaping and Treating of Steel, vol. 2—Ironmaking", Fruehan, et al., eds., pp. 547-642. 1999.
Struve, G.V., et al., "Future Process and Design Aspects in Iron Ore Pelletizing", The Australian Institute of Mining and Metallurgy, Pellets and Granules Symposium, Oct. 1974.

* cited by examiner

METHOD FOR PRODUCING AN AGGLOMERATE MADE OF FINE MATERIAL CONTAINING METAL OXIDE FOR USE AS A BLAST FURNACE FEED MATERIAL

This application is the U.S. National Phase of PCT Application Serial No. PCT/EP2010/057842, filed Jun. 4, 2010, which claims the priority of German Application Serial No. 102009023928.6-24, filed Jun. 4, 2009, both of which are incorporated herein by reference in their entirety.

The invention relates to a method for producing an agglomerate comprising metal- and/or metal oxide containing fines and a mineral binder. The invention also relates to a blast furnace feedstock that can be produced by a method according to the invention, and a premixture for producing the blast furnace feedstock.

Apart from lump ore, it is known to use substances containing fine particle iron ore in the production of blast furnace feedstock. Substances containing fine particle iron ore for example arise when sieving lump ores or from other preparation methods. The use of these fine particle ores has the advantage that these ores are readily available and cost-effective. The fine particle ores are normally agglomerated prior to use. In this way, the formation of dust in the blast furnace can be kept low. The agglomeration also has the advantage that the agglomerates formed can be easily melted and have a good gas permeability. Thus the reduction gases can be drawn through the ore without the exertion of high forces. Finally by using agglomerates the amount of material falling through the grate can be reduced.

A common form of agglomeration of fine particle ores is pelletisation. The use of pellets in a furnace, such as a blast furnace, is not without its problems however, since the pellets often do not have sufficient mechanical strength. This has a disadvantageous effect in particular during transport and handling of the pellets. Furthermore, the known pellets are often not sufficiently permeable to hot reduction gases, as occurring in the blast furnace, making the melting of these more difficult.

A further common form of preparing fine ores that are not ready for immediate use is sintering. In this way fine ores can also be used which because of their grain size and characteristics can only be agglomerated with difficulty. Fine ores that are not ready for immediate use and are difficult to agglomerate typically have an average grain diameter of up to 2 mm, more typically of 0.2 to 0.7 mm, in particular of 0.2 mm to 0.5 (intermediate grain sizes). As binders lime-based products are normally used. Lime-based products increase the cohesion of the fine ores. Nevertheless, the proportion of fine ores that are hard to agglomerate remains limited, since a higher proportion of these grain sizes weakens the cohesion of the sintered product and can also lead to high dust discharge from the sinter belt. Furthermore, a higher proportion of intermediate grain sizes also worsens the gas permeability of the sintered product and leads to a higher proportion of returns during sinter treatment.

A high proportion of use of intermediate grain sizes at the sintering stage is desirable, however, since ore containing intermediate grain sizes is particularly readily available and cost-effective. In order to increase the quantity of intermediate grain sizes in the fine ores, it is proposed in the prior art to use lime-based products together with products containing clay mineral as binders. Thus, published application 1029568 describes a method for pre-treatment of ores to be sintered on gratings by means of agglomeration prior to the sintering using bentonite or another clay as binder. Following agglomeration a lime-containing powder is added to the product.

With this method also, however, the proportion of intermediate grain sizes in the starting material is limited to a maximum of 30 wt. %.

From EP 1359129 A2 an aggregate is known for producing autoclave-cured construction materials, comprising a mineral filler with a silicon oxide proportion of at least 60 wt. %, preferably 75 wt. % and a finest grain proportion of less than 2 μm of at least 40 wt. % of the aggregate.

The object of the invention is to provide a method for producing an agglomerate which can be used as a blast furnace feedstock, and with which the above problems in the prior art can be overcome.

In particular, a method shall be provided in which fine ore with a high proportion of intermediate grain sizes can be used and nevertheless a sintered product with a high cohesion and a good gas permeability can be obtained. Furthermore, the sintered product shall have a low dust discharge. Finally, during sinter treatment a low proportion of returns shall be obtained.

Additionally, a method is to be provided in which fine ore with a high proportion of intermediate grain sizes can be used but nevertheless pellets with a high mechanical strength can be obtained.

This object is achieved according to the invention by a method for producing an agglomerate, which is used as a blast furnace feedstock, by mixing metal- and/or metal oxide containing fines, a mineral binder comprising a mineral raw material and a lime-based material and optionally conventional additives to form a mass and consolidating the mass to form an agglomerate, wherein as the mineral raw material a raw material is used which comprises a silicon oxide proportion of at least 40 wt. % and a finest grain proportion of less than 4 μm of at least 20 wt. %, wherein the grain size proportion of less than 1 μm is at least 10 wt. %.

It has surprisingly been found that when producing the agglomerates of the kind mentioned above metal- and/or metal oxide containing fines with a surprisingly high proportion of intermediate grain sizes can be used if as the binder a lime-based material together with a mineral raw material comprising a silicon oxide proportion of at least 40 wt. %, and a finest grain proportion of less than 4 μm of at least 20 wt. % and a grain size proportion of less than 1 μm of at least 10 wt. %, is used.

With the method according to the invention fine ore with a high proportion of intermediate grain sizes can be used and nevertheless a sintered product with high cohesion and a good gas permeability can be obtained. Furthermore, sintered product with a low dust discharge can be obtained, which also has a low proportion of returns. A further advantage of the method according to the invention is that the sintering process can be performed with excellent kinetics.

According to the invention, the term "ore containing intermediate grain sizes" means metal- and/or metal oxide 30 containing fines with an average grain diameter of below 1 mm, preferably of 0.05 mm to 1 mm, more preferably of 0.2 to 0.7 mm, in particular of 0.1 to 0.5 mm.

If with the method according to the invention agglomerates in the form of a sintered product are to be produced, then according to the invention it is possible to use fines with a proportion of ore containing intermediate grain sizes of more than 30 wt. % and nevertheless to obtain a sintered product with an excellent cohesion.

If with the method according to the invention agglomerates in the form of pellets are to be produced, then according to the invention it is possible to use fines with a proportion of ore containing intermediate grain sizes of more than 30 wt. % and nevertheless to obtain pellets with a high mechanical strength.

An important procedural step in the method according to the invention is the use of a lime-based material together with a mineral raw material as binder.

As mineral raw material basically the various substances can be used which comprise a silicon oxide proportion of at least 40 wt. %, and a finest grain proportion of less than 4 μm of at least 20 wt. % as well as a grain size proportion of less than 1 μm of at least 10 wt. %.

Practical trials have shown that when raw materials containing clay mineral are used, the proportion of intermediate grain sizes in the method according to the invention can be particularly high and nevertheless sintered product with a high cohesion and/or pellets with good mechanical strength can be obtained.

Excellent results are achieved with a mineral raw material comprising a silicon oxide proportion of at least 60 wt. %, preferably at least 75 wt. %, and a finest grain proportion of less than 2 μm of at least 40 wt. %, wherein the grain size proportion of less than 0.5 μm is at least 25 wt. %.

The use of a raw material containing clay mineral, preferably an unbaked raw material containing two- and/or three-layer clay minerals has proven to be particularly favourable.

The use of a raw material containing clay mineral, comprising short clay, consisting of at least 60 wt. % of fine quartz and 20 to 40 wt. % kaolinite and optionally secondary micas has proven to be particularly advantageous.

Exceptionally suitable is a mineral raw material comprising 70 to 90 wt. %, preferably approximately 83 wt. % silicon oxide, 5 to 20 wt. %, preferably approximately 13 wt. % aluminium oxide, 0.2 to 1.5 wt. %, preferably approximately 0.7 wt. % $Fe_2O_3$ and 0.1 to 1 wt. %, preferably approximately 0.4 wt. % potassium oxide. The use of Calexor® Q HP as mineral binder is particularly suitable.

In some cases it is expedient to use the mineral raw material with a substantially continuous grain size distribution.

In the first step of the method according to the invention the metal- and/or metal oxide containing fines and the mineral binder are mixed together. The mixing of fines and binder can be performed in the various ways known to a person skilled in the art. The mixing of fines and binder in a mixing unit is particularly easy.

The proportion of metal- and/or metal oxide containing fines and mineral binder can have a broad range of variation and will be matched expediently to the nature and the grain size structure of the fines and the binder used. Practical trials have shown that normally for a proportion of the metal- and/or metal oxide containing fines to the mineral binder of 5:1 to 1000:1, preferably of 10:1 to 100:1, agglomerates with particularly good strength characteristics can be obtained.

It has become evident that in some cases the agglomerate formation can be made easier if the mass containing the fines and the binder has a certain mass humidity. Depending on the inherent humidity of the fines and the binder, the mass humidity can be adjusted by extraction or addition of water. The level of mass humidity can be expediently adjusted as a function of various factors such as the composition and grain size distribution of the fines and binder used. A further important factor is the way in which the agglomeration is performed. Normally mass humidities in the range of 2 to 20 wt. %, preferably 4 to 10 wt. %, achieve good results.

As the metal- and/or metal oxide containing fines the widest variety of fines can be used. According to the invention, the term "metal- and/or metal oxide containing fines" means powdery to finer materials. These preferably have average particle sizes of 0.01 to 10 mm. The use of materials with average particle sizes of 0.05 to 3 mm, in particular of 0.1 to 2 mm, has proven to be particularly suitable. Preferably up to 50 wt. % of the particle sizes of the fines fall in the grain size range between 0.1 and 2 mm.

Particularly expedient is the use of fine ore, in particular fine iron ore, tinder material, in particular mill scale, top gas dust, returns from the sintering process, metal abrasive dust and/or metal filings as metal- and/or metal oxide containing fines.

According to the invention the binder contains a lime-based material. Particularly suited lime-based materials according to the invention are lime, lime stone, quick lime, slaked lime, hydrated lime, dolomite, dolomitic lime, dolomitic quick lime, dolomitic hydrated lime and mixtures of these.

In some cases it has proven favourable, in addition to the binder, to add additional consolidators, preferably inorganic thickeners, in particular water glass, sugar solution, aluminium chromate and/or phosphate. In this way the strength of the agglomerate can be further increased.

The quantity of additional consolidators depends on the degree of consolidation to be achieved. Normally with just the addition of 0.3 to 1.5 wt. % of additional consolidators in relation to the mixture of fines and binders good results are obtained.

Packing additives can also be added to the mixture in order to lower the curing temperature, such as for example low-melting siliceous materials, in particular a glass powder and/or phonolite.

According to a particularly preferred embodiment of the invention for the fines ore containing intermediate grain sizes is used in a mixture with sinter feed. Particularly preferably the proportion of ore containing intermediate grain sizes in the fines is higher than 30 wt. %, preferably higher than 50 wt. %, more preferably higher than 70 wt. %, and in particular higher than 90 wt. %, in each case in relation to the total quantity of fines.

Agglomerates produced by a sintering process have proven to be particularly suitable for use in blast furnaces. Thus the production of a sintered product constitutes a particularly preferred embodiment of the invention. The advantages of sintering are inter alia that the agglomerates can be pre-reduced and losses on ignition in the blast furnace can be avoided.

The course of the sintering process will be known to a person skilled in the art and can for example take the following form. Initially a mixture is created containing fine ores, circulating materials, fuel, in particular coke breeze, mineral binder and sinter screening. This mixture is mixed with water and layered on a sinter belt. The fuel contained in the mixture is for example ignited by natural gas and/or top gas flames. The induced draught fan located below the sinter belt now pulls the front of the burning material through the mixture, so that the sinter cake is fully burnt through when it reaches the discharge end of the belt. The heat which is generated in the process melts the fine ores on the surface, so that the grains are firmly bonded. The sinter cake is cooled and classified after it has been broken. So-called grate coatings and sinter returns may remain in the sintering plant. The finished sinter is then fed into the blast furnace.

According to a particularly preferred embodiment of the invention consolidating the mass to form the agglomerate is performed by a sintering process. For this purpose preferably a mixture, containing the fines and the mineral binder, is mixed with water, common blast furnace circulating materials, preferably ladle residues and/or slags, fuel, preferably coke breeze, and optionally condensed. The thus obtained mixture then undergoes heat treatment at a temperature that is below the melting temperature of the mixture, resulting in the formation of a sinter cake. By breaking the sinter cake it is possible to obtain the agglomerate according to the invention.

Practical trials have shown that it is advantageous if when sintering the starting materials are selected in such a way that at least a minimal cohesion of the individual particles is provided for. For this reason it is preferable according to the invention if the fines used contain proportions with a grain size of less than 2 mm, preferably of 0.05 mm to 1 mm, preferably in a quantity of at least 30 wt. %.

An important process step in sintering is the heat treatment of the starting materials. This cures the mass of fines and binder. Preferably the curing is based on a sintering process with the formation of a siliceous sinter matrix, comprising a glass phase and optionally a crystalline phase, in particular a mullitic phase. The siliceous sinter matrix is preferably a glassy matrix, in which crystalline particles are stored. With these it is preferably a case of a primary mullite.

The curing process takes place preferably by means of heat treatment at temperatures of between 800 and 1200° C. The dwell times vary preferably within a range of less than 90 minutes. In this way the mineral raw material can form a melt phase, which preferably results in a glassy cured sinter matrix with a crystalline proportion, in particular granular mullite or primary mullite, in which the metal- or metal oxide containing fines are embedded. If a high porosity of the sintered products is desired, then this can be brought about in a simple manner by subjecting a mass with a higher water content to the sintering process.

The sinter produced with the method according to the invention is exceptionally well-suited for use as a blast furnace feedstock.

Good results are also achieved with agglomerates produced by the method according to the invention in the form of pellets, briquettes and/or granulates.

For the production of pellets the mixture of fines and binder can be mixed with water and the conventional pelletization aggregates, the mixture obtained is formed into green pellets and the green pellets cured in a combustion process.

The curing of the pellets can also be performed hydraulically. In a preferred embodiment of the invention the mixture of fines, binder and water also has a hydraulic consolidator added, the mixture obtained is formed into green pellets and the green pellets cured. Of course, hydraulic consolidators can also be used in the production of sintered products.

As hydraulic binders preferably cement, in particular Portland cement, Portland cement clinker, aluminium oxide cement, aluminium oxide cement clinker, cement mixed with blast furnace slag, cement mixed with fly ash, cement mixed with Borazon and/or bentonite, are used. Various additives can also be mixed together with the hydraulic binder.

Advantageous in the use of a hydraulic binder is that firing of the green pellets can be dispensed with. In this way the production costs of the blast furnace feedstock can be reduced and the release of harmful gases such as for example $SO_X$ and $NO_X$ during the combustion process can be avoided.

The production of the pellets can be carried out in the manner known to a person skilled in the art in a shaft furnace, a travelling grate furnace or a travelling grate/rotary furnace.

In order to prevent the pellets sticking together, in particular in the moist state, the pellets can be provided with a coating prior to curing. Suitable coating materials are preferably inorganic substances, for example iron ore powder. The thickness of the coating is preferably no greater than 0.5 mm.

The presence of water in the mass makes the pellet formation easier. The mass humidity should not be too high, however, since otherwise the surface of the pellets becomes moist and sticky. Moist and sticky pellets in particular often have insufficient strength and exhibit a tendency to collapse under their own weight, as a result of which the gas permeability of the pellets is reduced.

The size of the pellets can vary in broad ranges. Pellets with a diameter of 1 to 20 mm, preferably 3 to 10 mm have proven to be particularly well-suited to the blast furnace process.

The invention further relates to a blast furnace feedstock which can be produced with the method according to the invention.

The blast furnace feedstock can be introduced into the blast furnace as the only metal- and/or metal oxide containing material. According to the invention it is preferable for the blast furnace feedstock to be introduced into the blast furnace together with further metal- and/or metal oxides containing material. It is particularly expedient if the blast furnace feedstock according to the invention accounts for a proportion of 30 to 80 wt. %, preferably of 40 to 70 wt. % and in particular of 55 to 65 wt. % of the total iron carriers for the blast furnace operation.

A further subject matter of the invention is a premixture for producing the blast furnace feedstock according to the invention containing metal- and/or metal oxide containing fines and a mineral binder comprising a mineral raw material and a lime-based material, wherein the metal- and/or metal oxide containing fines have a proportion of fines with an average grain diameter of less than 1 mm, preferably of 0.05 mm to 0.9 mm and in particular of 0.1 to 0.5 mm, of more than 30 wt. %, in each case in relation to the total quantity of fines.

For the mineral raw material preferably a raw material is used as described in relation to the method according to the invention.

According to a preferred embodiment of the invention the proportion of fines with an average grain diameter of less than 1 mm, preferably of 0.05 mm to 0.9 mm and in particular of 0.1 to 0.5 mm in the premixture according to the invention is more than 50 wt. %, preferably 70 wt. % to 100 wt. %, more preferably 80 wt. % to 100 wt. % and in particular 90 wt. % to 100 wt. %, in each case in relation to the total quantity of fines.

According to a further preferred embodiment of the invention the proportion of fines with an average grain diameter of more than 1 mm, preferably of more than 1 mm to 3 mm and in particular of more than 1 mm to 2 mm in the premixture according to the invention is less than 50 wt. %, preferably 0 to 30 wt. %, more preferably 0 to 20 wt. %, and in particular 0 to 10 wt. %, in each case in relation to the total quantity of fines.

According to a further preferred embodiment of the invention the premixture contains 50 to 99 wt. %, preferably 60 to 90 wt. %, in particular 70 to 85 wt. % metal- and/or metal oxide containing fines and 1 to 20 wt. %, preferably 1 to 15 wt. %, conventional additives and mineral binder.

Preferably the proportion of mineral binder in the premixture should not exceed 15 wt. %. In this way the quantity of slag arising in the blast furnace can be kept low.

According to a further preferred embodiment of the invention the mineral binder has 30 to 98 wt. % lime-based material and 2 to 70 wt. %, preferably 10 to 60 wt. %, mineral raw material.

According to a further preferred embodiment of the invention the premixture contains 0 to 30 wt. % additives, preferably coke breeze, ladle residue and/or slag.

A further subject matter of the invention is a premixture for producing the blast furnace feedstock according to the invention containing metal- and/or metal oxide containing fines and a mineral binder comprising a mineral raw material and a lime-based material, wherein as the mineral raw material a raw material is used comprising a silicon oxide proportion of at least 40 wt. %, and a finest grain proportion of less than 4 μm of at least 20 wt. % and a grain size proportion of less than 1 μm of at least 10 wt. %.

With regard to further preferred embodiments of the premixtures according to the invention reference is made to the embodiments of the method according to the invention.

The invention further relates to the use of a mineral binder comprising a mineral raw material and a lime-based material and optionally conventional additives, for producing an agglomerate, which is used as a blast furnace feedstock, wherein as the mineral raw material a raw material is used which comprises a silicon oxide proportion of at least 40 wt. %, and a finest grain proportion of less than 4 μm of at least 20 wt. % and a grain size proportion of less than 1 μm of at least 10 wt. %.

The use according to the invention comprises both the combined as well as the separate addition of mineral raw material and lime-based material.

With regard to further preferred embodiments of the use according to the invention reference is made to the embodiments of the method according to the invention.

In the following the invention is illustrated in more detail by way of an example.

Five different sinter belt mixtures (mixture 1, 2, 3, 3a, 3b) are produced. In order to produce mixtures 3a and 3b fines, comprising a defined proportion of intermediate grain sizes, are mixed with the respective binder and conventional sinter excipients and the mass humidity is adjusted. For the mixture according to the invention 3b a mineral raw material is used as the binder, comprising a silicon oxide proportion of at least 40 wt. %, and a finest grain proportion of less than 4 μm of at least 20 wt. % and a grain size proportion of less than 1 μm of at least 10 wt. %.

Mixtures 1, 2 and 3 are produced without the addition of binder. Then the mixture is mixed with water and layered on a sinter belt. The mixture has a specific gas permeability, which can be measured using the pressure loss in an air flow forced through the mixture. A low pressure loss indicates a good gas permeability. A good gas permeability is desirable in the sintering process since it leads to a good burning through of the sinter cake.

In the following table, the pressure losses for mixtures 1, 2, 3, 3a, 3b are illustrated. A comparison of mixtures 1, 2, 3 shows that an increase in the proportion of intermediate grain sizes leads to an increase in pressure loss and to a reduction in gas permeability. A comparison of mixtures 3, 3a shows that through the addition of CaO as binder an improved gas permeability can be achieved.

Using the example 3b according to the invention it was possible to prove that through use of the special mineral binder a mixture with a particularly good gas permeability can be obtained.

| Mixture | Proportion of ore containing intermediate grain sizes (wt. %) | Mass humidity (wt. %) | Binder | Pressure loss (Pa) |
|---|---|---|---|---|
| 1 | 7 | 6.6 | 0 | 340 |
| 2 | 21 | 7.6 | 0 | 580 |
| 3 | 36 | 7.6 | 0 | 1300 |
| 3a | 36 | 7.6 | CaO (1.6 wt. %) | 780 |
| 3b | 36 | 7.6 | mineral binder (2.4 wt. %) | 420 |

The invention claimed is:

1. Method for producing an agglomerate, having a mass humidity that can be adjusted, which is used as a blast furnace feedstock, by mixing metal- and/or metal oxide containing fines, comprising a proportion of intermediate grain sizes between about 0.2 mm to 0.7 mm of more than 30% wt., a mineral binder comprising a mineral raw material and a lime-based material to form a mass and consolidating the mass to form an agglomerate, by a sintering process, characterized in that the mineral raw material contains a clay mineral and comprises a silicon oxide proportion of at least 40 wt. % and a finest grain proportion of less than 4 μm of at least 20 wt. %, and a grain size proportion of less than 1 μm of at least 10 wt. %.

2. Method according to claim 1, characterized in that a mineral raw material is used, comprising short clay that consists of at least 60 wt. % of fine quartz and 20 to 40 wt. % kaolinite and optionally secondary micas.

3. Method according to claim 2, characterized in that a mineral raw material is used comprising 70 to 90 wt. % silicon oxide, 5 to 20 wt. % aluminium oxide, 0.2 to 1.5 wt. % $Fe_2O_3$ and 0.1 to 1 wt. % potassium oxide.

4. Method according to claim 3, characterized in that the mixing of fines and binder takes place in a mixing unit.

5. Method according to claim 4, characterized in that the metal- and/or metal oxide containing fines and the mineral binder are mixed together in a proportion of 5:1 to 1000:1 wt.:wt.

6. Method according to claim 5, characterized in that when mixing fines and binder the mass humidity is set at a value of 2 to 20 wt. %.

7. Method according to claim 2, characterized in that a mineral raw material is used comprising approximately 83 wt. % silicon oxide, approximately 13 wt. % aluminium oxide, approximately 0.7 wt. % $Fe_2O_3$ and approximately 0.4 wt. % potassium oxide.

8. Method according to claim 1, wherein the lime-based material is selected from the group consisting of lime, lime stone, quick lime, slaked lime, hydrated lime, dolomite, dolomitic lime, dolomitic quick lime, dolomitic hydrated and combinations thereof.

9. Method according to claim 1 wherein the metal- and/or metal oxide containing fines are selected from the group consisting of fine ore, fine iron ore, tinder materials, mill scale, top gas dust, returns from the sintering process, metal abrasive dust, metal filings and combinations thereof.

10. Method according to claim 1, wherein additional conventional sintering additives are added to the mixture of fines and binder and are selected from the group consisting of coke breeze, ladle residue, slags, and combinations thereof.

11. Method according to claim 10, characterized in that the sintering process comprises:

mixing of fines, mineral binder, water, conventional blast furnace circulating materials and fuel to form a mixture;

heat treatment of the mixture wherein an agglomerate in the form of a sinter cake is produced.

12. Method according to claim 11, characterized in that the sinter cake is broken, wherein an agglomerate in the form of a finished sinter is obtained.

13. Method according to claim 1, characterized in that fines containing a grain size proportion of less than 2 mm, in a quantity of at least 30 wt. % are used.

14. Method for producing an agglomerate comprising the following steps:

step a) providing metal- and/or metal oxide containing fines, wherein said fines have intermediate grain sizes between about 0.2 mm to 0.7 mm and the proportion of ore containing this intermediate grain size fine is more than 30% wt., step b) providing a mineral binder which contains a mineral raw material and a lime based material; wherein said mineral raw material comprises a clay mineral wherein said clay mineral comprises a silicon oxide in a proportion of at least 40 wt. %, and a finest grain proportion of less than 4 μm of at least 20 wt. % and a grain size proportion of less than 1 μm of at least 10 wt. % and wherein said lime-based material is selected from lime, lime stone, quick lime, slaked lime, hydrated lime, dolomite, dolomitic lime, dolomitic quick lime, dolomitic hydrated lime and mixtures or any combinations of these materials;

step c) mixing the metal- and/or metal oxide containing fines from step a with the mineral binder from step b to obtain a mixture;

step d) heat treatment of the mixture of metal- and/or metal oxide containing fines from step a with the a mineral binder from step b to obtain an agglomerate.

* * * * *